US012359524B2

(12) United States Patent
Whitby

(10) Patent No.: US 12,359,524 B2
(45) Date of Patent: Jul. 15, 2025

(54) OILFIELD SEAL TOOL

(71) Applicant: Schlumberger Technology Corporation, Sugar Land, TX (US)

(72) Inventor: Ross Whitby, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/542,013

(22) Filed: Dec. 15, 2023

(65) Prior Publication Data

US 2025/0198249 A1 Jun. 19, 2025

(51) Int. Cl.
*E21B 33/06* (2006.01)

(52) U.S. Cl.
CPC ..... *E21B 33/06* (2013.01)

(58) Field of Classification Search
CPC ..... E21B 33/08; E21B 33/085; E21B 33/06
See application file for complete search history.

(56) References Cited

U.S. PATENT DOCUMENTS

2006/0037744 A1* 2/2006 Hughes ..... E21B 33/085 166/85.4
2009/0101333 A1* 4/2009 Williams ..... E21B 33/085 166/84.1
2012/0118559 A1* 5/2012 Li ..... E21B 33/085 166/84.3
2014/0027129 A1* 1/2014 Hannegan ..... E21B 33/085 166/387
2014/0262205 A1* 9/2014 Baker ..... E21B 33/085 166/85.4
2015/0376970 A1* 12/2015 Hughes ..... E21B 33/03 166/84.1
2018/0058169 A1* 3/2018 Le ..... E21B 17/01
2018/0334876 A1* 11/2018 Zonoz ..... E21B 33/085
2021/0189826 A1* 6/2021 Gallagher ..... E21B 21/08
2021/0301606 A1* 9/2021 Mikalsen ..... E21B 21/01
2021/0348470 A1* 11/2021 Tenorio ..... E21B 33/085

OTHER PUBLICATIONS

Neolid Twizz Double Wall Tumbler. YouTube Video viewed at https://www.youtube.com/watchv=OWQTQ_aVuvQ, 2019, 1 page.

* cited by examiner

*Primary Examiner* — Shane Bomar
(74) *Attorney, Agent, or Firm* — Jeffrey D. Frantz

(57) ABSTRACT

A tool capable of forming a seal includes a base, a member, and a seal member. The base includes an inner surface defining a bore configured to be in fluid communication with a well. The member is coupled to the base and rotatable relative to the base from a first position to a second position. The seal member includes an opening, a first end fixed to the member, and a second end fixed to the base. Rotation of the member from the first position to the second position rotates the first end relative to the second end to decrease a size of the opening.

20 Claims, 7 Drawing Sheets

OILFIELD SEAL TOOL

BACKGROUND

An annular blowout preventer (BOP) is installed on a wellhead to seal and control an oil and gas well during drilling operations. A drill string may be suspended inside an oil and gas well from a rig through the annular BOP into the well bore. During drilling operations, a drilling fluid is delivered through the drill string and returned up through an annulus between the drill string and a casing that lines the well bore. In the event of a rapid invasion of formation fluid in the annulus, commonly known as a "kick," the annular BOP may be actuated to seal the annulus and to control fluid pressure in the wellbore, thereby protecting well equipment disposed above the annular BOP. The construction of various components of the annular BOP can affect operation of the annular BOP.

BOPs have become increasingly complex to form a robust seal to control the well during drilling operations. Some conventional BOPs include one or more fingers, such as inserts, that are moved by an actuator to engage a tubular string to form a seal. Some conventional BOPs use one or more fingers or elements to axially compress a seal, such as a donut shaped seal, to form a seal against a tubular string. The complexity of conventional BOPs increases manufacturing costs and maintenance costs. There is a need in the art for a tool that can form a seal with less component parts to reduce the complexity of the tool forming the seal to reduce costs while forming a robust seal to block fluid flow.

SUMMARY

Aspects of the present disclosure provide systems, apparatus, and methods for deforming a seal member by rotating one end relative to another end to form a seal to block a well fluid.

In one aspect, a tool includes a base, a member, and a seal member. The base includes an inner surface defining a bore configured to be in fluid communication with a well. The member is coupled to the base and rotatable relative to the base from a first position to a second position. The seal member includes an opening, a first end fixed to the member, and a second end fixed to the base. Rotation of the member from the first position to the second position rotates the first end relative to the second end to decrease a size of the opening. In some embodiments, the size of the opening may be decreased to change the flow of a well fluid in the bore. In some embodiments, the size of the opening may be decreased to form a seal.

In one aspect, a method of forming a seal includes rotating a first end of a seal member relative to a second end of the seal member to form a seal within a structure connected to a well.

In one aspect, a method includes rotating a member of a seal tool coupled to a well relative to a base of the seal tool from a first position to a second position to rotate a first end of a seal member of the seal tool fixed to the member relative to a second end of the seal member fixed to the base to deform the seal member from an undeformed state into engagement against a tubular.

The following description and the appended figures set forth certain features for purposes of illustration.

BRIEF DESCRIPTION OF DRAWINGS

The appended figures illustrate only exemplary embodiments and are therefore not to be considered limiting of the scope of the disclosure, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Aspects of the present disclosure provide systems, apparatus, and methods for forming a seal to block flow of a well fluid. The seal may be formed by twisting a seal member, such as rotating one end of the seal member relative to the second end of the seal member, to deform the seal into a sealing engagement.

Figure 1:
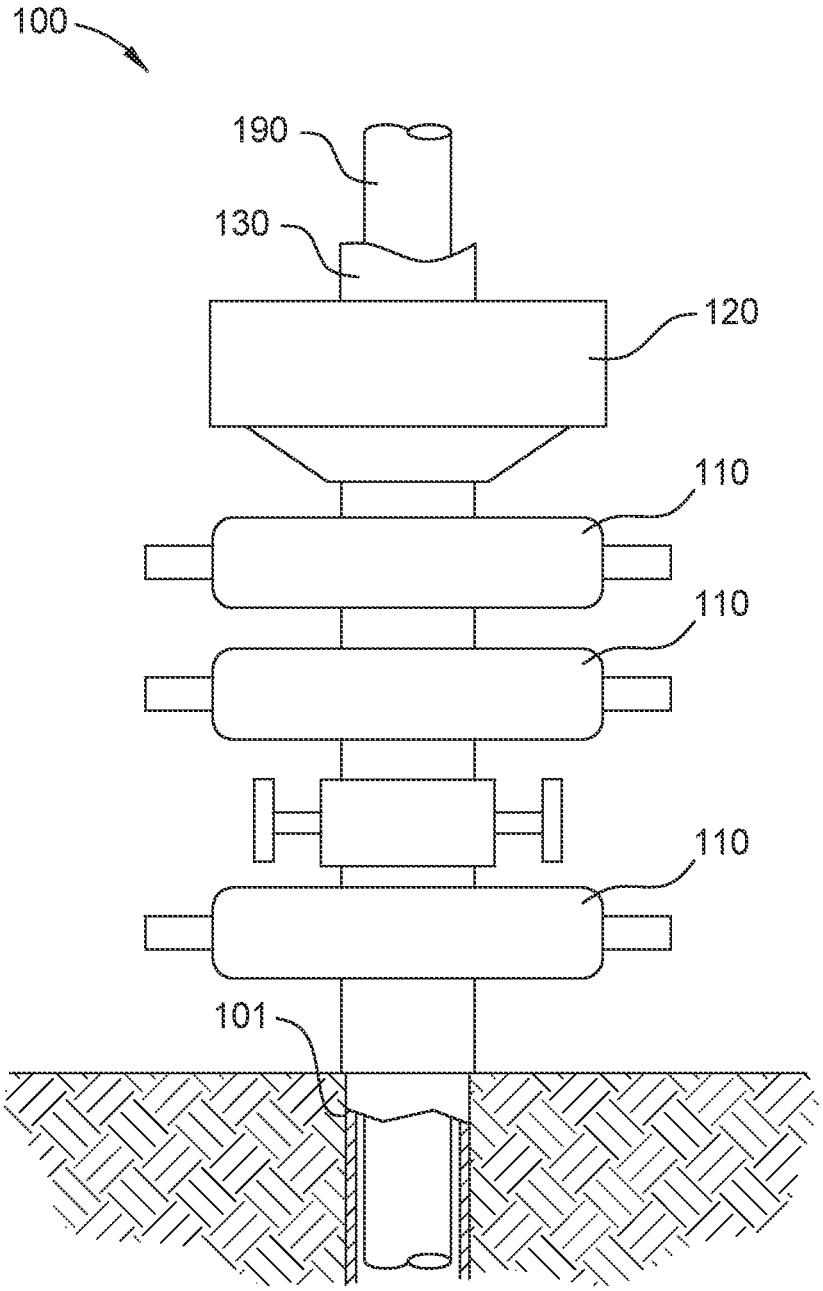
FIG. 1 illustrates a schematic view of a blowout preventer stack, according to one or more embodiments of the disclosure.

FIG. 1 illustrates a schematic view of a blowout preventer ("BOP") stack 100 to ensure pressure control of a well 101. The BOP stack 100 includes a plurality of shear rams 110 and an annular blowout preventer 120 coupled to a stack tubular member 130 connected to the well 101. A tubular string 190, such as a drill string, may extend through the BOP stack 100. An annulus is present between the outer surface of the tubular string 190 and the inner bore of the BOP stack 100. The shear rams 110 may be activated in response to a well control event, such as a kick, to extend a shear ram to cut and hang-off the tubular string 190. The annular blowout preventer 120, which may be seal tool 200 shown in FIG. 2A, may be operated in response to a well control event to rotate one end of a seal member relative to a second end of a seal member to twist, and thus deform, the sealing member into a tight sealing engagement with the outer surface of the tubular string 190 to close the annulus, thereby preventing flow through the annulus.

In some embodiments, the BOP stack 100 may include one to six shear rams 110 and one or two annular blowout preventers 120 positioned at the top of the BOP stack 100. The BOP stack 100 may also include various spools, adapters and piping outlets to permit the circulation of well fluids under pressure in the event of a well control event.

Figure 2A:
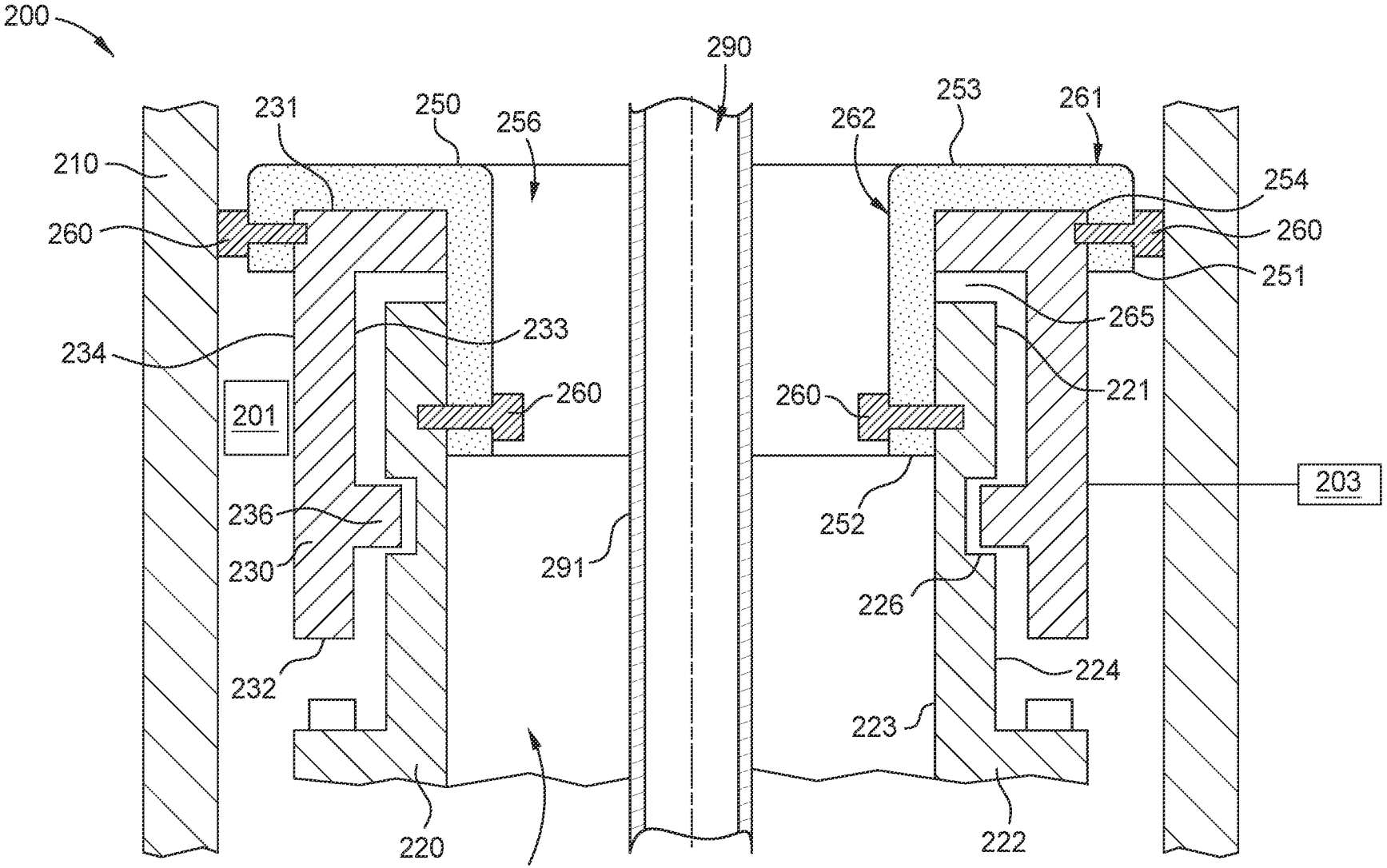
FIG. 2A illustrates a schematic cross-sectional view of a seal tool with a seal member in an undeformed state, according to one or more embodiments of the disclosure.

FIG. 2A illustrates a schematic cross-sectional view of a seal tool 200 that includes a seal member that is deformable from an undeformed state to a deformed state to form a seal to block a flow path. The seal tool 200 is coupled to a well, such as a land-based or a subsea well. In some embodiments, the seal tool 200 may be the annular BOP 120.

The seal tool 200 may include an actuator 201, a housing 210, a base 220, a member 230, and a seal member 250. A bore 202 extends through the seal tool 200, such as extending through the member 230 and the base 220. In some embodiments, the seal tool 200 is controlled by a controller 203.

FIG. 2A illustrates the seal tool 200 with the member 230 in a first position and the seal member 250 in an undeformed state. A well fluid may be circulated through the bore 202 when the seal member 250 is in the undeformed state. The well fluid may be a fluid circulated downhole, such as a drilling fluid, such as a drilling fluid that is pumped through a riser coupled to the well in a subsea embodiment. The well fluid may also be a fluid originating downhole, such as a reservoir fluid.

Figure 2B:
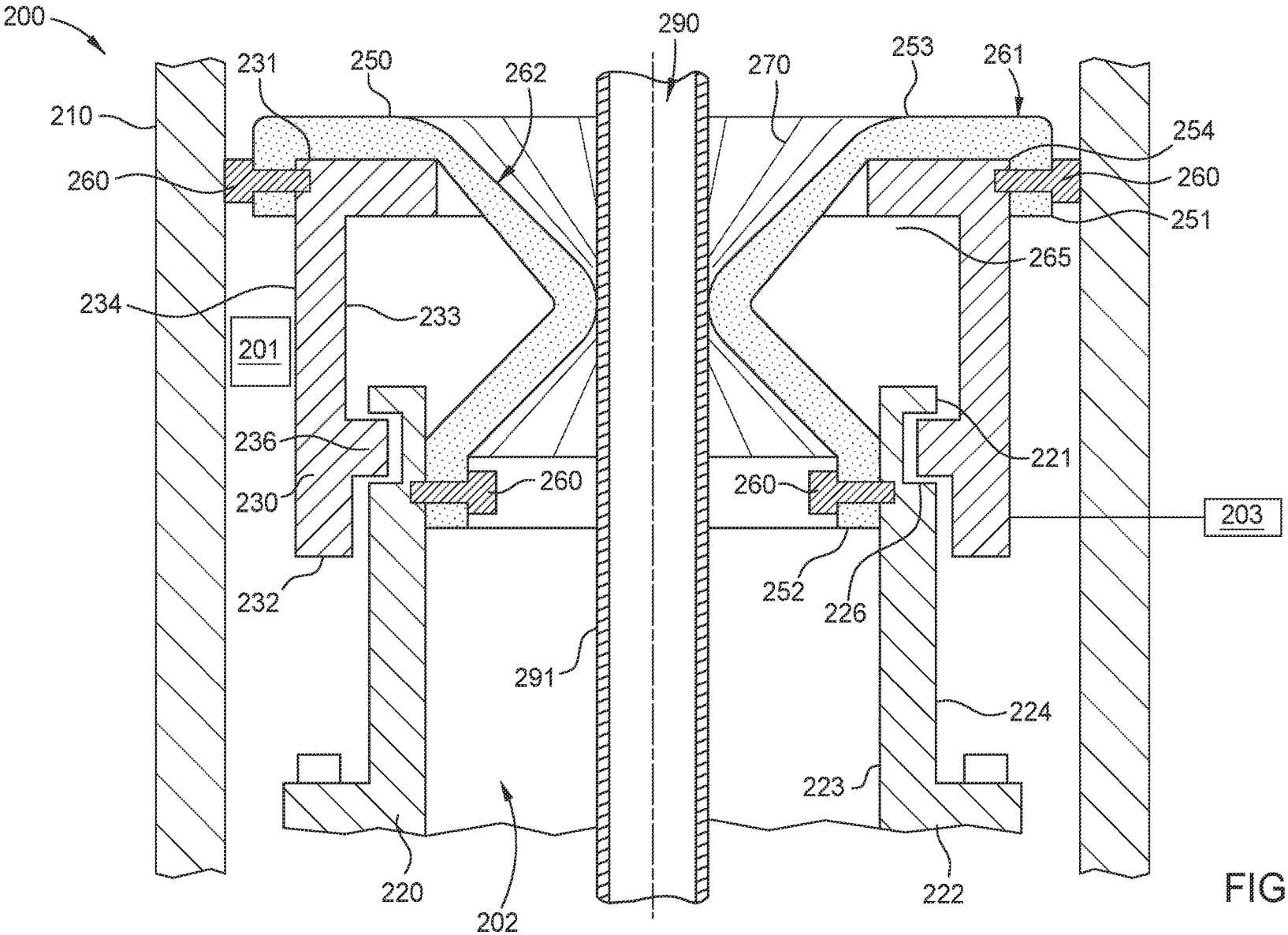
FIG. 2B illustrates a schematic cross-sectional view of the seal tool of FIG. 2A with the seal element in a deformed state in sealing engagement with a tubular string.
Figure 2C:
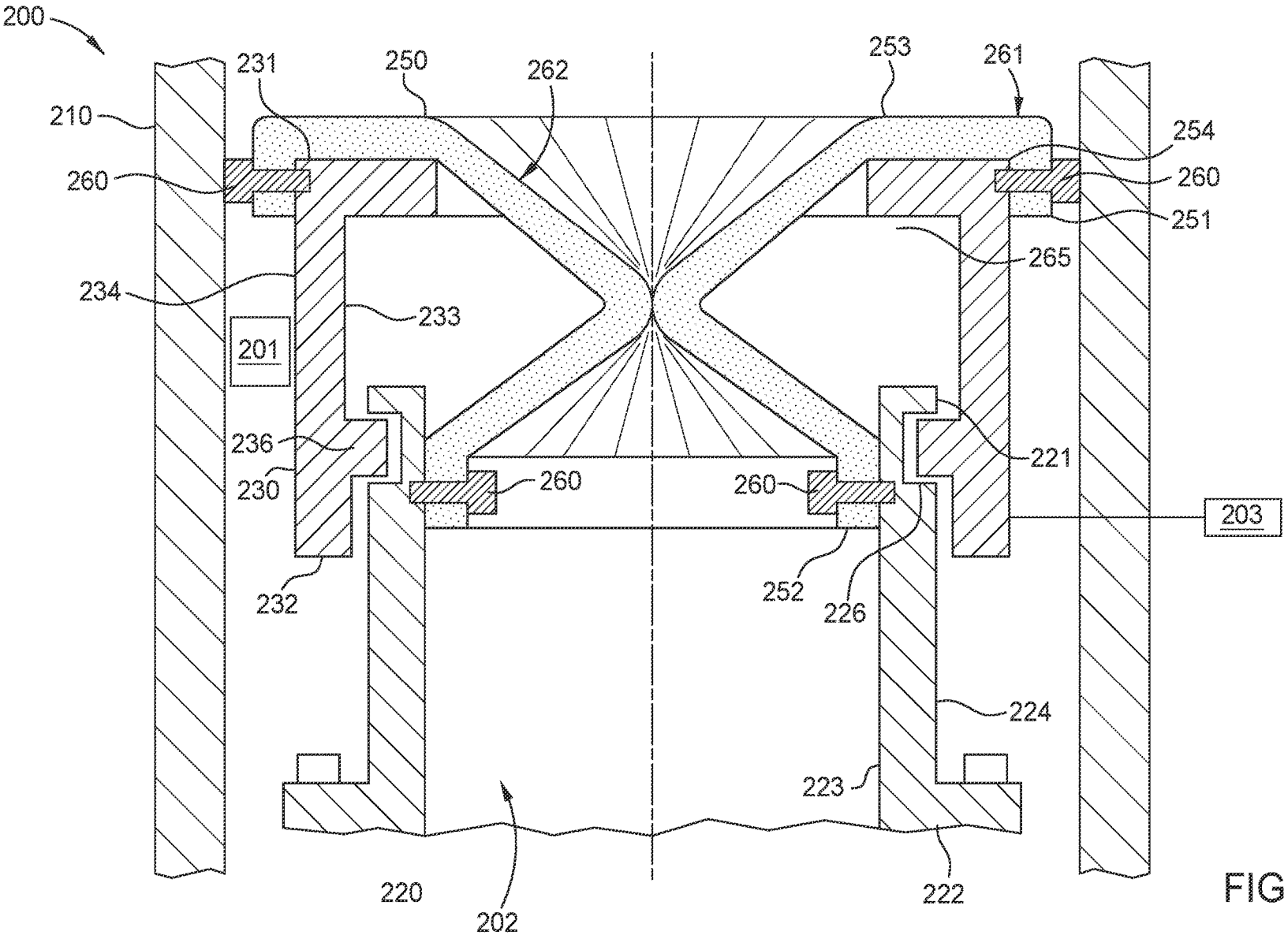
FIG. 2C illustrates a schematic cross-sectional view of the seal tool of FIG. 2A with the seal element in a deformed state to close a bore of the seal tool to a fluid flow.

FIG. 2B illustrates a schematic cross-sectional view of the seal tool 200 with the member 230 in a second position and the seal member 250 in a deformed state. The seal member 250 is in a sealing engagement with a tubular string 290 disposed in the bore 202 to block the flow of the well fluid through the bore 202. FIG. 2C is a schematic cross-sectional view of the seal tool 200. FIG. 2C is similar to FIG. 2B except the tubular string 290 is not present. Instead, FIG. 2C illustrates the seal tool 200 with the member 230 in the second position and the seal member 250 in a deformed state such that the bore 202 is closed and fluid communication of the well fluid is prevented through the bore 202.

The actuator 201, base 220, member 230, and seal member 250 may be disposed within the housing 210. The housing 210 may be a tubular housing connected to another tool, part of another tool, or connected to a structure coupled to the well. For example, the seal tool 200 may be incorporated in the place of annular blowout preventer 120 of the BOP stack 100, and the housing 210 may be connected to the stack tubular member 130 at a lower end.

The base 220 is held (e.g., maintained) in a fixed position to facilitate the deformation of the seal member 250. In some embodiments, the base 220 is fixed to the housing 210 or fixed to another component. For example, the base 220 may be fixed to a structure coupled to the well, such as the lower end of the base 220 being attached to the upper end of the stack tubular member 130 by a plurality of fasteners. In some embodiments, the member 230 is moved axially relative to the base 220 in a first axial direction (e.g., upwards) while also being rotated in a first rotational direction, such as a clockwise direction, about the base 220 to twist and thus deform the seal member 250 from an undeformed state (FIG. 2A) to a deformed state (FIG. 2B or FIG. 2C). For example, the member 230 may be moved from the first position (FIG. 2A) to the second position (FIG. 2B or FIG. 2C), which moves the member 230 in the first axial direction while rotating about the base 220 in the first rotational direction, to change the seal member 250 from the undeformed state to the deformed state. Thus, the seal member 250 is also stretched in addition to being twisted as the seal member 250 is deformed to form a seal in some embodiments.

In some embodiments, the member 230 may be moved axially relative to the base 220 in a second axial direction (e.g., downwards), that is opposite the first axial direction, while being rotated in the a second rotational direction, such as counter-clockwise, about the base 220 to release the torsion in the seal member 250 and allow the seal member 250 to return to the undeformed state from the deformed state. For example, the member 230 may be moved from the second position (FIG. 2B or FIG. 2C) to the first position (FIG. 2A), which moves the member 230 in the second axial direction while rotating about the base 220 in the second rotational direction to change the seal member 250 from the deformed state to the undeformed state.

Figure 2D:
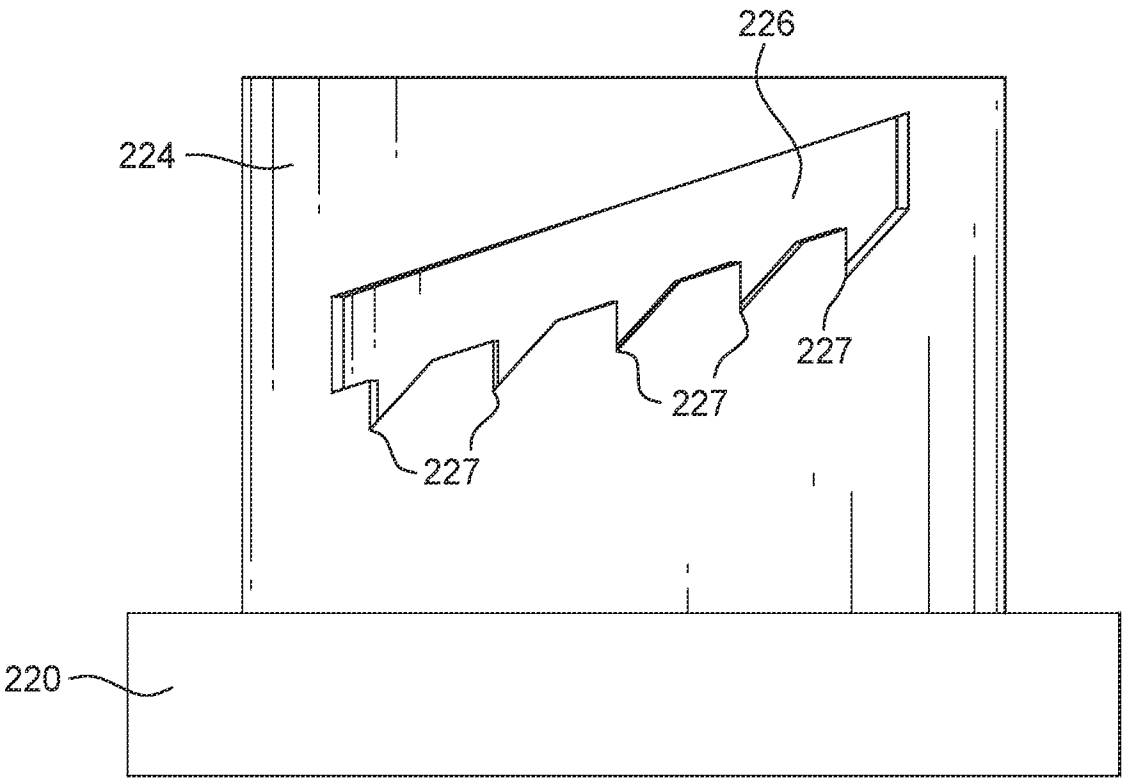
FIG. 2D lustrates a side view of a base of the seal tool of FIG. 2A.

The base 220 may be a tubular member. The base 220 includes an upper end 221, a lower end 222, an inner surface 223, and an outer surface 224. The inner surface 223 of the base 220 may at define part of the bore 202. In some embodiments, the outer surface 224 includes one or more slots 226 formed thereon. FIG. 2D is a perspective view of the base 220 to show an exemplary slot 226. Each slot 226 may be angled, such as extending along an angled trajectory of a desired degree of rotation of the member 230 relative to the base 220. Each slot 226 may include one or more lock portions 227 as shown in FIG. 2D, which may be an enlarged area or pocket of the slot 226 extending from a lower surface of the slot 226. The lock portions 227 may be spaced based on a desired rotational position(s) of the member 230 relative to the base 220 as the member 230 moves in the first rotational direction and first axial direction, such as being spaced every few degrees along the length of the slot 226. For example, the slot 226 may be a j-slot, with the lock portion 227 being formed at the end of the j-slot.

The member 230 may be a tubular member. The member 230 includes an upper end 231, a lower end 232, an inner surface 233, and an outer surface 234. In some embodiments, the inner surface 233 includes one or more elements 236, such as keys or lugs, formed thereon. In some embodiments, each element 236 is disposed in a corresponding slot 226 of the base 220. In other embodiments, multiple elements 236 may be disposed in a corresponding slot 226. A gap 265 may be present between a lower side (portion of the inner surface 233) of the upper end 231 of the member 230 and an upper side (e.g., top surface) of the upper end 221 of the base 220. In some embodiments, the lower side of the upper end 231 of the member 230 and the upper side of the upper end 221 of the base 220 may contact in the first position of the member 230. In other words, the gap 265 may not be present in the first position of the member 230. The size of the gap 265 increases as the member 230 moves in the first axial direction and decreases as the member 230 moves in the second axial direction.

The slots 226 and elements 236 cooperate to guide the rotational and axial movement of the member 230 relative to the base 220 to change the state of the seal member 250. Each element 236 slides along the corresponding slot 226 as the member 230 is moved axially in the first axial direction and rotationally in the first rotational direction relative to base 220, such as sliding along the bottom side of the slot 226. The element 236 may engage with a corresponding lock portion 227 of the slot 226 as the member 230 moves relative to the base 220 in the first rotational direction and first axial direction, such as the element 236 sliding downward into the lock portion 227. The engagement of the element 236 with the lock portion 227 of the slot 226 along with the angle of the slot 226 prevents the member 230 from unintentionally counter-rotating backwards in the second rotational direction. If the member 230 were to counter-rotate in the second rotational direction, then torsion of the seal member 250 would be reduced, potentially causing a failure of the integrity of the seal formed by the seal member 250. Therefore, the lock portions 227 are configured to lock the member 230 in a position relative to the base 220. The lock portions 227 are shaped to allow the element 236 to advance along the slot 226, such as advancing to the next lock portion 227 along the slot 226 as the member 230 rotates in the first rotational direction. In some embodiments, the member 230 may be positioned as it rotates in the second rotational direction such that the elements 236 slide along the top side of the slot 226 instead of the bottom side of the slot 226 that includes the lock portions 227. In some embodiments, the element 236 is located at a first end of the slot 226 (e.g., left side of slot 226 in FIG. 2D) in the first position and located at a second end of the slot 226, such as in a lock portion 227 on the right side of the slot 226 in FIG. 2D, when in the second position.

As provided above, the base 220 may include one or more slots 226 arranged around the outer surface 224. In some embodiments, the base may include two, three, four, or more slots 226 arranged around the outer surface 224. In some embodiments, the slots 226 are sized to allow the member 230 to rotate less than 180 degrees relative to the base 220. For example, the slots 226 may be sized to allow the member 230 to rotate about 100 degrees, about 90 degrees, about 80 degrees, about 70 degrees, or about 60 degrees to cause the formation of a seal with the seal member 250. In some embodiments, the slots 226 are sized to allow the member 230 to rotate 180 degrees relative to the base 220 or more than 180 degrees but less than 360 degrees relative to the base 220. Thus, in some embodiments, the member 230 may only be rotated a partial revolution relative to the base 220 to form the seal with the seal member 250.

In some embodiments, the member 230 may be rotated 360 degrees or more relative to the base 220 to form the seal with the seal member 250. For example, the slots 226 may be sized to allow for the member 230 to rotate 360 degrees or more relative to the base 220. Thus, in some embodiments, the member 230 may be rotated at least one full revolution to form the seal with the seal member 250.

In some embodiments, the member 230 includes the one or more slots 226 and the base 220 includes the one or more elements 236. In some embodiments, the base 220 and member 230 do not have a slot and element mechanism, such as the slots 226 and elements 236, to facilitate the rotational and axial movement of the member 230 relative to the base 220. Instead, the member 230 and base may have a different mechanism, such as gearing or a plurality of bearings, to facilitate the rotational and/or axial movement of the member 230 relative to the base 220.

The actuator 201 is used to move the member 230 axially and rotationally relative to the base 220 to one or more positions. The actuator 201 may be a hydraulic actuator, a pneumatic actuator, or an electric actuator. For example, the actuator 201 may include a ring piston, such as a hydraulically actuated ring piston. In some embodiments, the actuator 201 may include one or more gears that interface with gear teeth formed on the outer surface 234 of the member 230. The actuator 201 may also position the elements 236 to slide along the top surface of the slot 226 as the member 230 is rotated in the second rotational direction.

The controller 203 may be used to actuate the actuator 201. The controller 203 may be in the form of a computer-based control system, e.g. a microprocessor-based control system, a programmable logic control system, or another suitable control system for providing desired control signals to and/or from the actuator 201. The controller 203 may send an instruction to the actuator 201 to actuate to move the member 230 to a position to change the deformation of the seal member 250.

The seal member 250 may be a cylindrical seal element as shown in FIG. 2A. The seal member 250 includes a first end 251, a second end 252, an inner surface 253, and an outer surface 254. The seal member 250 includes opening 256 defined by the outer surface 254. This opening 256 is reduced in size as the seal member 250 is deformed such that the inner surface 253 of the seal member 250 forms a seal to prevent fluid communication through the bore 202.

The first end 251 of the seal member 250 is fixedly attached (e.g., fixed) to the member 230, such as being attached to the outer surface 234. Thus, the first end 251 of the seal member 250 is rotationally fixed to the member 230. The first end 251 may be attached to the member 230 by one or more fasteners, such as bolts 260 shown in FIG. 2A. The first end 251 may also be attached by a bond, such as an adhesive bond, between the first end 251 and the outer surface 234 of the member 230.

The second end 252 of the seal member is fixedly attached to the base 220, such as being attached to the inner surface 223. Thus, the second end 252 of the seal member 250 is rotationally fixed to the base 220. The second end 252 may be attached to the base 220 by one or more fasteners, such as bolts 260 shown in FIG. 2A. The second end 252 may also be attached by a bond, such as an adhesive bond, between the second end 252 and the inner surface 223 of the base 220. The movement of the member 230 relative to the base 220 causes the first end 251 of the seal member 250 to rotate and move axially relative to the second end 252. The movement of the first end 251 relative to the second end 252 changes the deformation of the seal member 250. The movement of the member 230 in the first axial direction and rotation in the first rotational direction causes the seal member 250 to twist, which increases the torsion in the seal member 250 and causes the seal member 250 to deform. The seal member 250 is also stretched as the member 230 moves axially in the first axial direction which causes tension in the seal member 250 that also deforms the seal member 250. The movement of the member in the second axial direction and rotation in the second rotation direction decreases the torsion and tension in the seal member 250 and thus decreases the deformation of the seal member 250.

The seal member 250 includes a first portion 261 and a second portion 262. The first portion 261 includes the first end 251 and the second portion 262 includes the second end 252. As shown in FIG. 2A, the first portion 261 is folded over the upper end 231 of the member 230, which contacts a portion of the outer surface 254 with the upper end 231. The first portion 261 may be at least partially engaged with a portion of the inner surface 233 of the member 230. The upper end 231 may be shaped, such as having a taper, to minimize abrasive or sharp edge contact with the outer surface 254 to limit wear and tear on the seal member 250. The second portion 262 extends past the upper end 231 of the member 230 and into the bore 202 to the second end 252. As shown, the inner surface 223 of the base 220 is in contact with the outer surface 254 of the second portion 262 of the seal member 250 disposed in the bore 202. Part of the second portion 262 spans the gap 265.

FIGS. 2B and 2C show the seal member 250 in the deformed state. A plurality of interfaces 270 (e.g., seam lines, fold lines) may form as the seal member 250 is deformed. These interfaces 270 are portions of the inner surface 253 of the seal member 250 that appear as a result of the deformation of the seal member 250. For example, the interfaces 270 may be folds or bulges of the inner surface 253 that appear as the seal member 250 is deformed. These interfaces 270 may engage an adjacent interface 270 as the seal member 250 deforms. The interfaces 270 disappear as the torsion and tension are released, such as not being present when the seal member 250 is in the undeformed state.

As the seal member 250 deforms, the seal member 250 transforms from a cylindrically shaped seal member 250 to being shaped similarly to a hyperboloid of revolution (e.g., circular hyperboloid). As shown in FIGS. 2B and 2C, the second portion 262 of the seal member 250 is deformed to resemble a hyperboloid of revolutions. The outer surface 254 of the second portion 262 is stretched to a generally hyperboloid shape.

The seal member 250 is formed from a resilient material, such as an elastomer material, that can form a seal that may withstand pressures from a well while maintaining the integrity of the seal. For example, the seal member 250 may be selected from a material that can form a seal that withstands the pressures of a well control event to prevent a blowout, such as withstanding pressures that exceeds about 3,000 psi, such as 5,000 psi, such as 10,000 psi, such as 15,000 psi. The material of the seal member 250 may be selected to have durability for long lasting operations under harsh physical and chemical conditions, including exposure to sharp edges of tubulars, $H_2S$, $CO_2$, corrosive materials, heat, high velocity stripping, tong marks on tool joints, rough hard banding, and/or various mud types and additives. In some embodiments, the seal member 250 may be an elastomer seal member, such as a fluoroelastomer. In some embodiments, the seal member 250 may be formed of a nitrile material, such as nitrile butadiene rubber (NBR) or a hydrogenated nitrile butadiene rubber (HNBR).

In some embodiments, the tubular string 290 is disposed within the bore 202 as shown in FIGS. 2A and 2B. FIG. 2A shows that an annulus is present between an outer surface 291 of the tubular string 290 and the seal member 250 when the seal member 250 is in an undeformed state. The seal tool 200 may be operated to deform the seal member 250 to engage the inner surface 253 of the seal member 250 with the outer surface 291 of the tubular string 290 as shown in FIG. 2B, thereby closing the annulus and forming a seal against the tubular string 290 to prevent fluid communication (e.g., seal) through the annulus. In some embodiments, the seal member 250 is first deformed to engage the tubular string 290 in order to center the tubular string 290 within the bore 202. For example, the member 230 may be moved from the first position to a third position that is between the first and second positions to cause the seal member 250 to deform into engagement with the tubular string 290 to center the tubular string 290 within the bore 202. The seal member 250 may or may not form a seal with the tubular member 290 while the tubular member 290 is being centered. After the tubular string 290 is centered, the seal member 250 may then be further deformed to form a tight sealing engagement with the outer surface 291 of the tubular string 290 to prevent fluid communication through the annulus. For example, the member 230 may move from the third position to the second position to deform the seal member 250 into a sealing engagement with the tubular string 290.

In some embodiments, the tubular string 290 is not present as shown in FIG. 2C. The seal tool 200 is operated to deform the seal member 250 such that the inner surface 253 engages upon itself to close the opening 256, thereby forming a seal that prevents fluid communication through the bore 202 as shown in FIG. 2C. In other words, the seal member 250 may be deformed to close the bore 202.

In some embodiments, the seal member 250 may be selectively deformed to form a desired restriction in the bore 202 to control flow through the bore 202, such as controlling a flow rate. The restriction is formed by changing the size of the opening 256. Thus, the seal tool 200 may be operated to selectively change the size of the opening 256 to control the flow through the bore 202.

The tubular string 290 is composed of individual tubulars, such as individual joints of drill pipe. A wide variety of sizes and shapes of tubular members, collars, tool joints, etc. are used in the oilfield. Thus, each tubular string 290 that can be inserted into the seal tool 200 can have a different outer diameter. The seal tool 200 can form a seal with any diameter of tubular member used to form the tubular string 290 since the seal member 250 can be deformed until it forms a sealing engagement with the outer surface of a piece of equipment located in the bore 202, such as the outer surface 291 of the tubular string 290. For example, the seal member 250 may form a seal with the outer surface 291 prior to the member 230 reaching the second position. The member 230 can continue to move to the second position to tighten the seal. Thus, the seal tool 200 can be used to form a seal with any size or shape of tubular, collar, tool joint, etc. that are insertable into the seal tool 200.

In some embodiments, the seal tool 200 is operated in response to a well-control event, such as a detected kick in the well. For example, the controller 203 may instruct the actuator 201 to operate the seal tool 200 to form a seal in response to a detected well-control event. In other embodiments, the seal tool 200 is operated to selectively form a seal to block a flow path, such as closing an annulus around a tubular string 290, to facilitate performing an operating on one or both sides of the seal. For example, an operator may use the controller 203 to instruct the actuator 201 to operate the seal tool 200 to form the seal.

Figure 3:
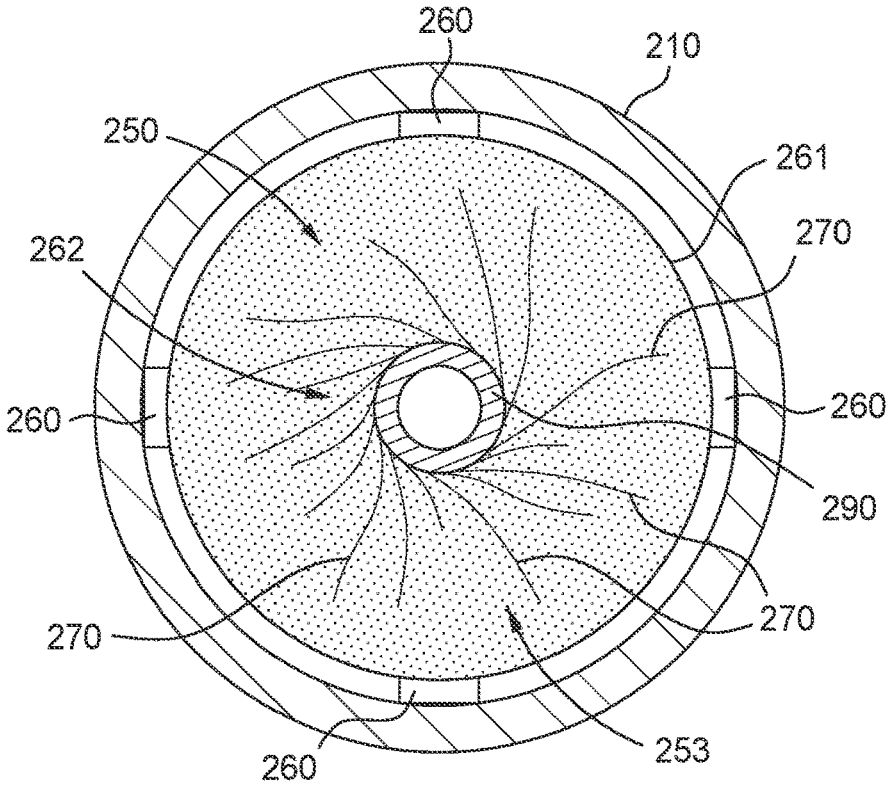
FIG. 3 is a top view of the seal tool of FIG. 2B.

FIGS. 2A and 2B show a sequence of operating the seal tool 200 to form a seal against the outer surface 291 of the tubular string 290, thereby closing an annulus. In some embodiments, the seal tool 200 is incorporated into the BOP stack 100 as the annular blowout preventer 120. The seal tool 200 may be operated in response to a detected well control event, such as a detected kick. The actuator 201 is actuated to cause the member 230 to move from the first position to the second position, which causes the first end 251 of the seal member 250 to rotate relative to the second end 252, which results in the seal member 250 deforming into tight sealing engagement with the tubular string 290, thereby forming a seal. FIG. 3 illustrates a top view of the seal tool 200 with the seal formed with the tubular string 290. As shown in FIG. 3, the seal member 250 is deformed into engagement with the tubular string 290 and a plurality of interfaces 270 emanate outward from the portion of the deformed seal member 250 that is engaged with the outer surface 291 of the tubular string 290. The seal tool 200 may maintain the seal until the well-control event is under control. When desired, the seal tool 200 may be operated again to remove the seal. The actuator 201 is actuated to move the member 230 from the second position to the first position to return the seal member 250 to the undeformed state. The actuator 201 may be actuated again to form the seal when desired, such as in response to a subsequent well control event.

Figure 4:
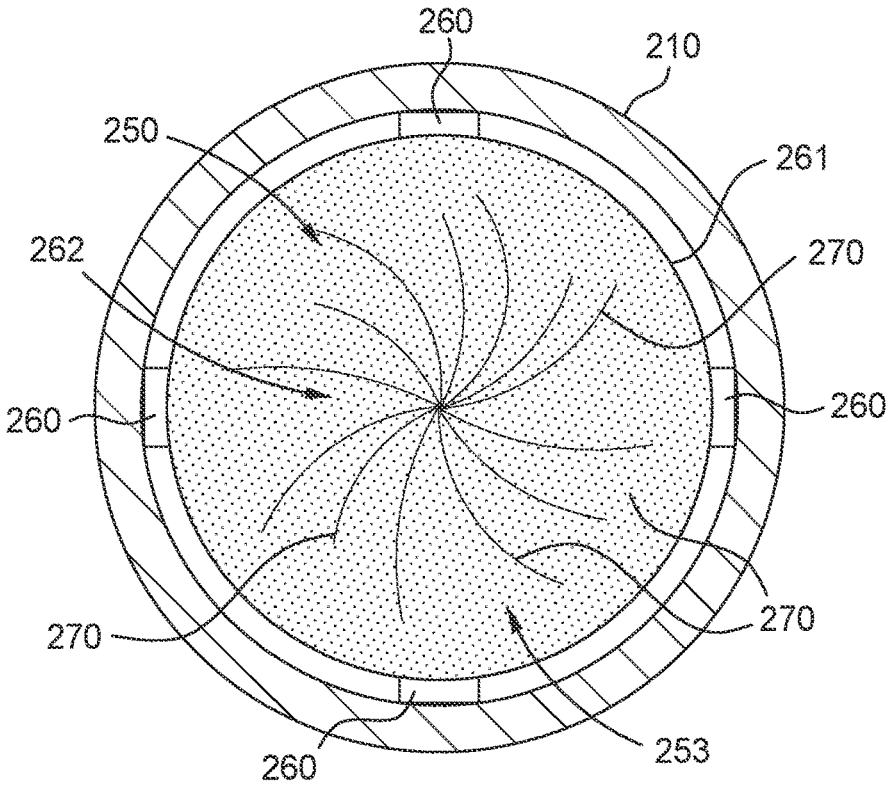
FIG. 4 is a top view of the seal tool of FIG. 2C.

FIG. 2A and FIG. 2C show a sequence of operating the seal tool 200 that closes the bore 202 to form a seal. In some embodiments, the seal tool 200 may be operated to close the bore 202 in response to a detected well control event. The actuator 201 is actuated to cause the member 230 to move from the first position to the second position, which causes the first end 251 of the seal member 250 to rotate relative to the second end 252, which results in the inner surface 253 closing upon itself to form a seal that closes the bore 202. FIG. 4 illustrates a top view of the seal tool 200 with the seal present in the bore 202. As shown in FIG. 4, the seal member 250 is deformed to eliminate the opening 256. A plurality of interfaces 270 emanate outward from the center of the seal member 250. The seal tool 200 may maintain the seal until the well-control event is under control. When desired, the seal tool 200 may be operated again to remove the seal and open the bore 202. The actuator 201 is actuated to move the member 230 from the second position to the first position to return the seal member 250 to the undeformed state. The actuator 201 may be actuated again to form the seal when desired, such as in response to a subsequent well control event.

In some embodiments, the seal tool 200 is a standalone tool incorporated into a structure coupled to a well, such as a marine riser or a BOP stack, that is selectively used to block flow through the tubular string, such as selectively forming a seal against an inner string disposed in the tubular string. In some embodiments, the seal tool 200 may be incorporated into another tool as a sealing mechanism, such as a rotating control device ("RCD"), to selectively create a seal. In some embodiments, the seal tool 200 is incorporated into an outer string to selectively form a seal that closes the bore of the outer string or to selectively form a seal against an inner string disposed in the bore of the outer string. In some embodiments, the seal tool 200 may be a configured as a packer that is incorporated into a tubular string, such as being incorporated into an inner tubular string that is inserted into an outer string. In some embodiments, the seal tool 200 may be a downhole tool or is incorporated into a downhole tool that is inserted downhole into the well.

In one embodiment, one or more seal tools 200 may be incorporated into an RCD coupled to the well, such that each seal member 250 serves as an annular seal member of the RCD. For example, the seal tool 200 may be a sub, such as a top sub, of the RCD. The base 220 may be rotationally coupled an outer barrel of the RCD and the seal member 250 may be disposed in a bore extending through the RCD.

In one embodiment, a telescopic riser joint of a riser coupled to a well may include the seal member 250 between an inner part that strokes relative to an outer part of the riser joint, with the outer part serving as the base 220 and the inner part serving as the member 230. In other embodiments, the seal tool 200 may be incorporated into the telescopic joint as a packer.

The seal tool 200 is described as the member 230 moving between a first and second position. In some embodiments, the first position is an open position of the seal tool 200 shown in FIG. 2A while the second position is a seal position of the seal tool 200 where the seal member 250 has formed a seal, such as what is shown in FIGS. 2B and 2C. The member 230 can move to multiple positions relative to the base 220, such as multiple positions between the first and second position. The member 230 can be moved to one or more position between the first and second positions to adjust the deformation of the seal member 250, such as changing the size of the opening 256. In some embodiments, the seal member 250 may be moved to one or more positions between the first position and the second position to form a seal, such as forming a seal with the tubular member 290.

In some embodiments of the seal tool 200, the member 230 is moved between the first and second positions by rotating the member 230 relative to the base 220 to rotate the first end 251 of the seal member 250 relative to the second end 252 to change the deformation of the seal member 250 to create or release the seal or to change a size of the opening 256 without moving in an axial direction relative to the base 220. For example, the one or more slots 226 may be linear slots rather than angled slots to facilitate the rotational movement of the member 230 relative to the base 220 without axial movement of the member 230.

The seal tool 200 has less components, and thus less points of failure, as compared to a conventional annular BOP, such as an annular BOP that includes elements and pistons to compress a seal element, such as a donut seal, into engagement with a tubular member. Additionally, the seal tool 200 is less expensive to manufacture than conventional annular BOPs while being able to provide the same or superior seals to block the flow of wellbore fluid. Unlike conventional BOPs, the seal tool 200 can be form a seal that closes the bore in addition to closing the annular. Additionally, the seal tool 200 can form a seal against any size tubular that will fit within the opening 256 of the seal element 250. Furthermore, the seal element 250 is self-centralizing, in that twisting the seal element 250 into engagement with a tubular member disposed in the opening 256 will centralize the tubular member.

Figure 5:
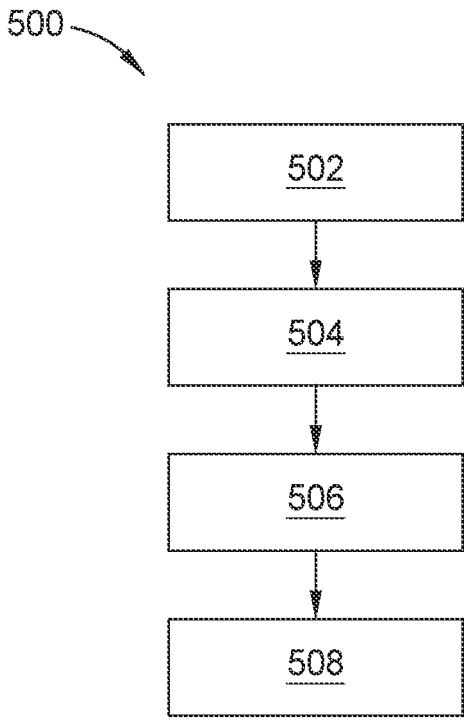
FIG. 5 is a flowchart of a method of actuating a seal tool coupled to a well, according to one or more embodiments of the disclosure.

FIG. 5 is a flowchart of a method 500 of actuating the seal tool 200 coupled to a well. In some embodiments, the well is land-based. In some embodiments, the well is offshore. In some embodiments of the method 500, the seal tool 200 is an annular BOP, part of an RCD, or incorporated into a riser, such as a telescopic riser joint.

At operation 502, the controller 203 instructs the actuator 201 to operate the seal tool 200 to form a seal. In some embodiments of operation 502, the controller 203 may send the instruction to the actuator 201 based on a detected a well-control event, such as a detected kick in the well. In some embodiments of operation 502, the controller 203 sends instruction to the actuator 201 based on an operator directing the operation of the seal tool 200 to form a seal.

At operation 504, the first end 251 of the seal member 250 is rotated relative to the second end 252 of the seal member 250 to form a seal within a structure connected to a well. In some embodiment, the structure coupled to the well may be a BOP stack, a riser, a telescopic joint of a riser, an RCD, or the seal tool 200. In some embodiments, the first end 251 is rotated by the actuator 201 by rotating the member 230 in a first rotational direction from the first position to the second position. In some embodiments, the member 230 moves axially relative to the base 220 as the member 230 moves from the first position to the second position.

In some embodiments of operation 504, the seal is formed by engaging the inner surface 253 of the seal member 250 with the outer surface 291 of the tubular string 290 disposed in the seal member 250, thereby closing the annulus between the seal member 250 and the tubular string 290. The seal prevents fluid communication of the well fluid past the seal. In some embodiments of operation 504, the tubular string 290 is not present and the seal is formed by engaging the inner surface 253 with itself to close the opening 256 of the seal member 250, thereby closing bore 202.

At operation 506, the controller 203 sends instructions to the actuator 201 to operate the seal tool 200 to release the seal. In some embodiments of operation 506, the controller 203 may send the instruction to the actuator 201 after the well-control event is under control. In some embodiments of operation 506, the controller 203 sends instruction to the actuator 201 based on an operator directing the operation of the seal tool 200 to release the seal.

At operation 508, the first end 251 of the seal member 250 is rotated relative to the second end 252 of the seal member 250 to release the seal within the structure connected to the well. In some embodiments, the first end 251 is rotated by the actuator 201 by rotating the member 230 in a second rotational direction from the second position to the first position. In some embodiments, the member 230 moves axially relative to the base 220 as the member 230 moves from the second position to the first position.

Figure 6:
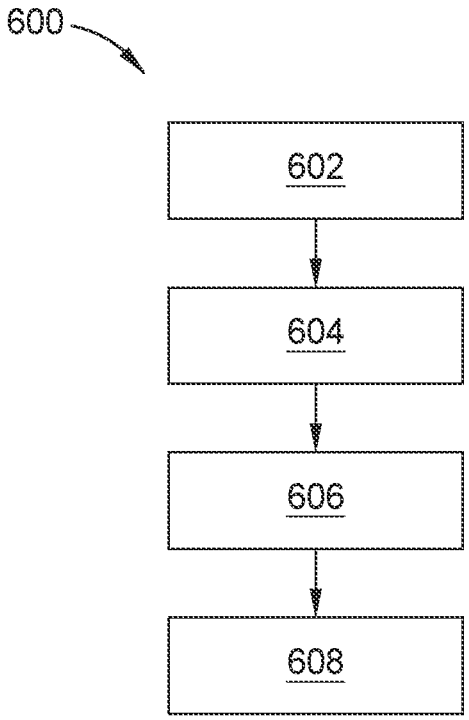
FIG. 6 is a flowchart of a method of actuating a seal tool coupled to a well, according to one or more embodiments of the disclosure.

FIG. 6 is a flowchart of a method 600 of actuating the seal tool 200 coupled to a well. In some embodiments, the well is land-based. In some embodiments, the well is offshore. In some embodiments of the method 600, the seal tool 200 is an annular BOP, part of an RCD, or incorporated into a riser, such as a telescopic riser joint.

At operation 602, a tubular, such as tubular string 290, is placed in the seal tool 200. The tubular is disposed in the bore 202 and is also disposed within the opening of 256 of the seal member 250. The tubular may be placed in the seal tool 200 while the member 250 is in a first position. In other words, the tubular may be placed in the seal tool 200 while the seal member 250 is in an undeformed state. The tubular may be a drill string used to drill through the formation to form the well, such as well 101.

At operation 604, the member 230 of the seal tool 200 coupled to the well is rotated in the first rotational direction relative to the base 220 from a first position to a different position to rotate the first end 251 of the seal member 250 fixed to the member 230 relative to the second end 252 of the seal member 250 fixed to the base 220 to deform the seal member 250 from an undeformed state into engagement against the tubular, such as tubular string 290, to center the tubular in the bore 202. The different position may be a position between the first position and the second position. The member 230 may be moved axially in the first axial direction while the member 230 is rotated in the first rotational direction. Operation 604 may occur in response to a detection of an off-center or tilted tubular. The controller 203 may send an instruction to actuator 201 to actuate the seal tool 200 to deform the seal member 250 into engagement with the tubular to center the tubular, such as sending the instruction once an off-center or tilted tubular is detected.

At operation 606, the member 230 is moved relative to the base 220 from the different position to the second position to further rotate the first end 251 of the seal member 250 relative to the second end 252 of the seal member 250 to further deform the seal member 250 into a sealing engagement with the tubular, thereby forming a seal against the tubular. This sealing engagement prevents fluid communication through the bore 202. Operation 606 may be an optional operation. Operation 606 may occur before or after operation 604. Operation 606 may occur in response to the detection of a well-control event. The controller 203 may send an instruction to the actuator 201 to actuate the seal tool 200 to form the seal against the tubular, such as sending the instruction once a well-control event is detected.

In some embodiments when operation 606 occurs after operation 604, the member 230 may be moved from the different position to the second position to further deform the seal member 250 into a sealing engagement with the tubular. Additionally, in some embodiments when operation 606 occurs after operation 604, the member 230 is moved from the first position to the second position to deform the seal member 250 into the sealing engagement with the tubular because the member 230 was moved from the different position to the first position after centering the tubular.

In some embodiments, such as when operation 606 occurs before operation 604, the member 230 is moved from the first position to the second position to deform the seal member into the sealing engagement with the tubular. The member 230 is then moved to the first position prior to operation 604.

In some embodiments of operation 606, the member 230 is locked in the second position to maintain the sealing engagement between the seal member 250 and the tubular. The member 230 may be locked in the second position by the engagement of an element 236 with a lock portion 227 of a slot 226. The actuator 201 may apply a downward axial force to secure the lock.

At operation 608, the member 230 is moved from the second position to the first position to return the seal member to the undeformed state to disengage the tubular. The member 230 is moved to the second position by rotating the member 230 relative to the base 220 in the second rotational direction. In some embodiments, the member 230 also moves axially relative to the base 220 as it rotates in the second rotational direction.

It is contemplated that any operation, activity, or example related to the method 500 may be incorporated into the method 600. It is further contemplated that any operation, activity, or example related to the method 600 may be incorporated into the method 500.

Embodiments of the present disclosure provide systems, apparatus, and methods for forming a seal by deforming a seal member by rotating one end of the seal member relative to another end of the seal member. The seal member can be deformed to fully close a bore or annulus to fluid flow to selectively provide a seal. The seal may be formed by the seal tool 200 described herein. The seal tool 200 has less moving parts and components as compared to conventional annular BOPs. Thus, the seal tool 200 advantageously can be used as an annular BOP with less points of failure that is also cheaper to manufacture and maintain than conventional annular BOPs.

Example Aspects

Implementation examples are described in the following numbered aspects:

Aspect 1: A tool, comprising: a base including an inner surface defining a bore configured to be in fluid communication with a well; a member coupled to the base and rotatable relative to the base from a first position to a second position; and a seal member defining an opening and disposed in the bore, a first end fixed to the member, and a second end fixed to the base, wherein rotation of the member from the first position to the second position rotates the first end relative to the second end to decrease a size of the opening.

Aspect 2: The tool of Aspect 1, wherein the size of the opening is decreased to close the opening in the second position.

Aspect 3: The tool of Aspect 1, wherein the size of the opening is decreased to close an annulus around a tubular disposed in the opening.

Aspect 4: The tool of any combination of Aspects 1-3, wherein the seal member further comprises: a first portion including the first end being folded over an upper end of the member; and a second portion of the seal member including the second end being disposed in the bore of the base.

Aspect 5: The tool of any combination of Aspects 1-4, wherein: a slot is formed in an outer surface of the base; and the member includes an element disposed in the slot, wherein the element moves in the slot as the member moves from the first position to the second position.

Aspect 6: The tool of Aspect 5, wherein the slot further comprises a lock portion configured to lock the element in the second position.

Aspect 7: The tool of any combination of Aspects 1-6, wherein the seal member is formed from a nitrile material.

Aspect 8: The tool of any combination of Aspects 1-7, wherein the tool is an annular BOP of a BOP stack.

Aspect 9: The tool of any combinations of Aspects 1-8, further comprising a housing, wherein the member, the seal member, and the base are disposed in the housing.

Aspect 10: The tool of any combinations of any Aspects 1-9, further comprising an actuator configured to rotate the member relative to the base.

Aspect 11: A method of forming a seal, comprising: rotating a first end of a seal member relative to a second end of the seal member to form a seal within a structure connected to a well.

Aspect 12: The method of Aspect 11, wherein the structure is a BOP stack, a riser, a telescoping riser joint, or a rotating control device.

Aspect 13: The method of any combination of Aspects 11-12, wherein forming the seal comprises engaging an inner surface of the seal member with an outer surface of a tubular disposed in the seal member and disposed in the structure.

Aspect 14: The method of any combination of Aspects 11-13, wherein forming the seal comprises closing an opening of the seal member to prevent communication through the structure.

Aspect 15: The method of any combination of Aspects 11-14, further comprising: rotating the first end relative to the second end to center a second tubular within the structure.

Aspect 16: A method, comprising: placing a tubular into a seal tool coupled to a well, the seal tool including a base, a member, and a seal member fixed at a first end to the member and fixed at a second end to the base; and rotating the member relative to the base from a first position to a second position, thereby rotating the first end of the seal member relative to the second end of the seal member to deform the seal member into engagement against the tubular.

Aspect 17: The method of Aspect 16, wherein rotating the member relative to the base from the first position to the second position to deform the seal member into engagement against the tubular centers the tubular within the seal tool.

Aspect 18: The method of any combination of Aspects 16-17, further comprising: rotating the member relative to the base from the second position to a third position, thereby further rotating the first end of the seal member relative to the second end of the seal member to deform the seal member to seal against the tubular.

Aspect 19: The method of Aspect 18, further comprising: locking the member in the third position to maintain the seal against the tubular.

Aspect 20: The method of any combination of Aspects 18-19, further comprising: rotating the member relative to the base from the third position to the first position, thereby rotating the first end of the seal member relative to the second end of the seal member to disengage the seal member from the tubular.

It is contemplated that any one or more elements or features of any one disclosed embodiment or example may be beneficially incorporated in any one or more other non-mutually exclusive embodiments or examples. While the foregoing is directed to embodiments of the present disclosure, other and further embodiments of the disclosure may be devised without departing from the basic scope thereof, and the scope thereof is determined by the claims that follow.

The following claims are not intended to be limited to the aspects shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112(f) unless the element is expressly recited using the phrase "means for". All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A tool, comprising:

a base including an inner surface defining a bore configured to be in fluid communication with a well;

a member coupled to the base and rotatable relative to the base from a first position to a second position; and a seal member defining an opening and disposed in the bore, the seal member comprising:

a first end fixed to the member;

a second end fixed to the base;

a first portion including the first end being folded over an upper end of the member; and a second portion including the second end being disposed in the bore of the base, wherein rotation of the member from the first position to the second position rotates the first end relative to the second end to decrease a size of the opening.

2. The tool of claim 1, wherein the size of the opening is decreased to close the opening in the second position.

3. The tool of claim 1, wherein the size of the opening is decreased to close an annulus around a tubular disposed in the opening.

4. The tool of claim 1, wherein:

a slot is formed in an outer surface of the base; and the member includes an element disposed in the slot, wherein the element moves in the slot as the member moves from the first position to the second position.

5. The tool of claim 4, wherein the slot further comprises a lock portion configured to lock the element in the second position.

6. The tool of claim 1, wherein the seal member is formed from a nitrile material.

7. The tool of claim 1, wherein the tool is an annular BOP of a BOP stack.

8. The tool of claim 1, further comprising a housing, wherein the member, the seal member, and the base are disposed in the housing.

9. The tool of claim 1, further comprising an actuator configured to rotate the member relative to the base.

10. A method, comprising:

placing a tubular into a seal tool coupled to a well, the seal tool including a base, a member, and a seal member fixed at a first end to the member and fixed at a second end to the base;

rotating the member relative to the base from a first position to a second position, thereby rotating the first end of the seal member relative to the second end of the seal member to deform the seal member into engagement against the tubular;

rotating the member relative to the base from the second position to a third position, thereby further rotating the first end of the seal member relative to the second end of the seal member to deform the seal member to seal against the tubular; and locking the member in the third position to maintain the seal against the tubular.

11. The method of claim 10, wherein rotating the member relative to the base from the first position to the second position to deform the seal member into engagement against the tubular centers the tubular within the seal tool.

12. The method of claim 10, further comprising:

rotating the member relative to the base from the third position to the first position, thereby rotating the first end of the seal member relative to the second end of the seal member to disengage the seal member from the tubular.

13. A tool, comprising:

a base including an inner surface defining a bore configured to be in fluid communication with a well;

a member coupled to the base and rotatable relative to the base from a first position to a second position; and a seal member defining an opening and disposed in the bore, the seal member comprising a first end fixed to the member, and a second end fixed to the base, wherein rotation of the member from the first position to the second position rotates the first end relative to the second end to decrease a size of the opening, wherein a slot is formed in an outer surface of the base, wherein the member includes an element disposed in the slot, and wherein the element moves in the slot as the member moves from the first position to the second position.

14. The tool of claim 13, wherein the slot further comprises a lock portion configured to lock the element in the second position.

15. The tool of claim 13, wherein the size of the opening is decreased to close the opening in the second position.

16. The tool of claim 13, wherein the size of the opening is decreased to close an annulus around a tubular disposed in the opening.

17. The tool of claim 13, wherein the seal member is formed from a nitrile material.

18. The tool of claim 13, wherein the tool is an annular BOP of a BOP stack.

19. The tool of claim 13, further comprising a housing, wherein the member, the seal member, and the base are disposed in the housing.

20. The tool of claim 13, further comprising an actuator configured to rotate the member relative to the base.

* * * * *